United States Patent [19]

Joffrion

[11] Patent Number: 4,464,493

[45] Date of Patent: Aug. 7, 1984

[54] PROCESS FOR DISSOLVING EPM AND EPDM POLYMERS IN OIL

[75] Inventor: Ralph K. Joffrion, Baton Rouge, La.

[73] Assignee: Copolymer Rubber & Chemical Corp., Baton Rouge, La.

[21] Appl. No.: 417,651

[22] Filed: Sep. 13, 1982

[51] Int. Cl.[3] ..... C08K 5/01

[52] U.S. Cl. ..... 523/319; 264/142; 524/324; 524/554

[58] Field of Search ..... 528/501; 264/14, 140; 425/67; 524/324, 554; 523/319

[56] References Cited

U.S. PATENT DOCUMENTS

| | | | |
|---|---|---|---|
| 2,929,107 | 3/1960 | Andrew | 425/67 |
| 2,979,769 | 4/1961 | Andrew | 425/67 |
| 3,014,246 | 12/1961 | Cook et al. | 425/67 |
| 3,185,660 | 5/1965 | Beste | 528/501 |
| 3,207,818 | 9/1965 | Marshall | 264/14 |
| 3,372,154 | 3/1968 | Turner et al. | 528/501 |
| 3,386,488 | 6/1968 | Ratzsch et al. | 528/501 |
| 3,427,003 | 2/1969 | Schneider et al. | 425/204 |
| 3,529,936 | 9/1970 | Muller-Rid et al. | 264/14 |
| 3,560,430 | 2/1971 | Meyer et al. | 523/319 |
| 3,814,563 | 6/1974 | Slaby et al. | 425/208 |
| 3,951,901 | 4/1976 | Bluemel et al. | 524/554 |
| 4,113,688 | 9/1978 | Pearson | 523/324 |

*Primary Examiner*—Jay H. Woo

*Attorney, Agent, or Firm*—McDougall, Hersh & Scott

[57] ABSTRACT

A method and apparatus of taking a solid, high molecular weight EPM or EPDM polymer into solution in oil as a shear stable viscosity index improver comprising passing the polymer through an extruder at elevated temperature for degradation of the polymer and circulating hot oil across the die face of the extruder while reducing the degraded polymer to particle size upon issuance from the extruder and into the hot oil.

8 Claims, 2 Drawing Figures

PROCESS FOR DISSOLVING EPM AND EPDM POLYMERS IN OIL

This invention relates to a method for processing elastomeric materials in forming a solution of such elastomeric materials of low molecular weight in oil.

The invention will be described with reference to the use of ethylene-propylene polymers and copolymers as shear stable viscosity index improvers in solution in lubricating oil. Polymers of the type described that have the desired shear stable properties for use as the viscosity index improvers are generally too low in molecular weight to be handled or to be shipped from manufacturer to user, in conventional rubber forms. To overcome this problem, use is currently being made of two different practices.

In one process the polymer is taken into oil solution during production of the polymer and is never handled as a neat polymer. Such oil solutions, generally containing 5–15% by weight of polymer, involve the handling and transportation of large volumes of oil. This markedly increases the cost of storage and transportation and thus penalizes the cost of the polymer.

In the other process, such as described in U.S. Pat. No. 4,146,489, a high molecular weight rubber that can be handled in conventional rubber form for shipment and storage as a solid material, is subjected to mechanical and/or thermal degradation at the station of use in order to reduce the rubber to the lower molecular weight, either before or after the rubber is dissolved in oil. When degraded after the rubber has been dissolved in oil, various viscous solutions must be processed and the oil component is frequently degraded with the polymer. When the polymer is degraded before dissolving in the oil, as in the aforementioned patent, a very low molecular weight and difficult to handle viscous polymer results, which is difficult to work with.

It is an object of this invention to provide a method and means for processing a shear stable viscosity index improver, in the form of an ethylene-propylene copolymer or terpolymer, which is not encumbered by the problem associated with current processes; which is more energy efficient than current processes, and which enables the handling of the polymer during transportation and solution in a simple and efficient low cost manner.

Figure 1:
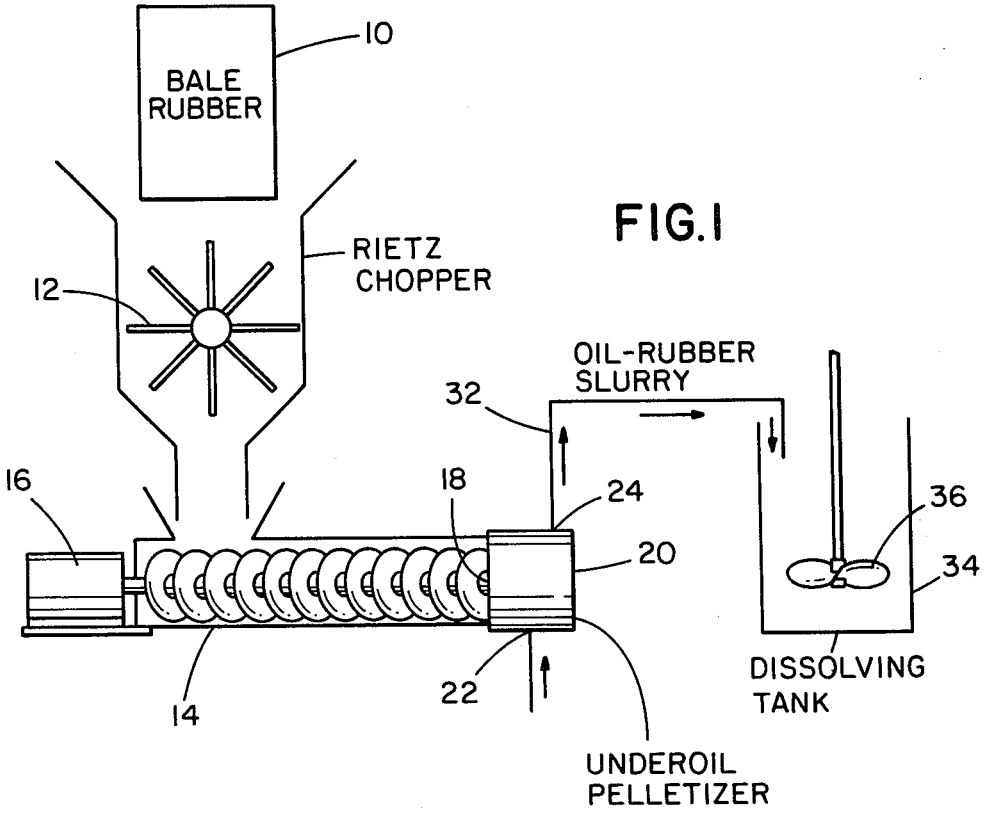
Figure 2:
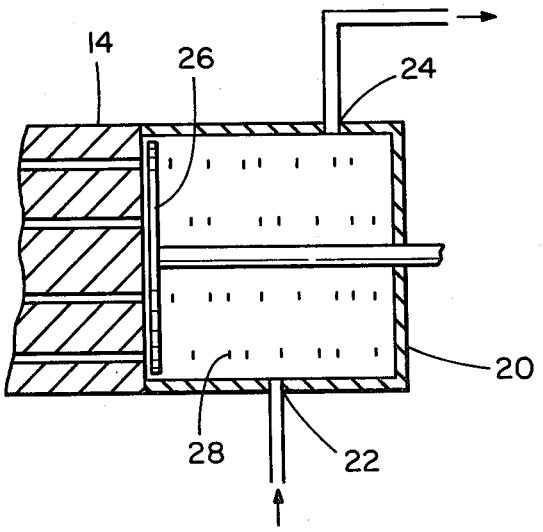

These and other objects and advantages of this invention will hereinafter appear and, for purposes of illustration, but not of limitation, an embodiment of the invention is shown in the accompanying drawings in which:

FIG. 1 is a schematic, diagrammatic showing of the arrangement of the equipment, and FIG. 2 is a sectional elevational view of the chamber mounted onto the die face of the extruder.

As viscosity index improvers, which may be employed in the practice of this invention, it is preferred to make use of an EPM or EPFM polymer which has been grafted with an organic compound containing polar groupings, but it will be understood that the concept of this invention will have application also to EPM and EPDM polymers which have not been grafted but which have been copolymerized to incorporate such groupings.

EPM polymers are formed by interpolymerization of monomers of ethylene and one or more higher mono-olefins having from 3 to 16 carbon atoms, preferably propylene. EPDM interpolymers are formed of the same ethylene, one or more higher mono-olefins as described above, plus one or more polyenes. The polyene monomers may be selected of branched chain monomers, straight or branched chain polyene or cyclic polyenes containing 4 to 20 carbon atoms and preferably 5 to 10 carbon atoms and two carbon to carbon double bonds. The preferred straight chain polyene is 1,4-hexadiene but other straight chain dienes can be used, such as discussed in U.S. Pat. No. 3,884,993.

The polyene or other ethlenically unsaturated compound containing a plurality of carbon-to-carbon double bonds may be selected from those disclosed in the prior art for use as third monomers in the preparation of ethylene-propylene-polyene terpolymers, including open chain polyunsaturated hydrocarbons containing 4–20 carbon atoms, such as 1,4-hexadiene, monocyclic polyenes and polycyclic polyenes. The polyunsaturated bridged ring hydrocarbons or halogenated bridged ring hydrocarbons are preferred. Examples of such bridged ring hydrocarbons include the polyunsaturated derivatives of bicyclo (2,2,1) heptane wherein at least one double-bond is present in one of the bridged rings, such as dicyclopentadiene, bicyclo(2,2,1)hepta-2,5-diene, the alkylidene norbornenes, and especially the 5-alkylidene-2-norbornenes wherein the alkylidene group contains 1–20 carbon atoms and preferably 1–8 carbon atoms, the alkenyl norbornenes, and especially the 5-alkenyl-2-norbornenes wherein the alkenyl group contains about 3–20 carbon atoms and preferably 3–10 carbon atoms. Other bridged ring hydrocarbons include polyunsaturated derivatives of bicyclo(2,2,2) octane as represented by bicyclo (2,2,2) octa-2,5-diene, polyunsaturated derivatives of bicyclo (3,21,) octane, polyunsaturated derivatives of bicyclo(3,3,1) nonane, and polyunsaturated derivatives of bicyclo(3,2,2) nonane.

Specific examples of preferred bridged ring compounds include 5-methylene-2-norbornene, 5-ethylidene-2-norbornene, 5-n-propylidene-2-norbornene, 5-isopropylidene-2-norbornene, 5-n-butylidene-2-norbornene, 5-isobutylidene-2-norbornene, dicyclopentadienes; the methyl butenyl norbornenes such as 5-(2-methyl-2-butenyl)-2-norbornene of 5-(3-methyl-2-butenyl)-norbornene, and 5-(3,5-dimethyl-4-hexenyl)-2-norbornene. The elastomer prepared from 5-ethylidene-2-norbornene is much preferred as it has outstanding properties and produces many unusual and unexpected results.

The elastomer may contain chemically bound therein molar ratios of ethylene to propylene varying between 95:10 to 55:45 propylene. The polyene or substituted polyene may be chemically bound therein to replace the ethylene or propylene in an amount of 0.1 to 10 mole percent, and preferably 0.3 to 1 mole percent, or in an amount to provide an actual unsaturation level of 2 double bonds per 1,000 carbon atoms in the polymer chain to unsaturation level as high as 100 double bonds per 1,000 carbon atoms in the polyene.

The term "organic compound containing polar groupings" has reference preferably to N-vinyl pyridine or N-vinyl pyrrolidone, but other organic compounds having functional or polar groups can be included, such as dimethylaminoethyl methacrylate or acrylate, vinylimidazole, N-vinylcarbazole,N-vinylsuccinimide, acrylonitrile, o-, m- or p-aminostyrene, maleimide, N-vinyl oxazolidone, N,N-dimethylaminoethyl vinyl ether, ethyl 2-cyanoacrylate, vinyl acetonitrile, N-vinylphthalimide, and 2-vinylquinoline; a variety of acrylamides and methacrylamides such as N-[3,1-dimethyl-3-oxobutyl] acrylamide, N-[dimethyl-1-ethyl-e-oxobutyl] acrylamide, N-(1,3-diphenyl-1-methyl-3-oxopropyl) acrylamide, N-(methyl-1-phenyl-3-oxobutyl) methacrylamide, N,N-diethylaminoethyl acrylamide; and 2-hydroxyethyl acrylamide. A variety of N-vinylcaprolactams or their thio- analogs, other than or in addition to N-vinylpyrrolidone, may be used in minor amounts. These include N-vinylthiopyrrolidone, 3-methyl-1-vinylpyrrolidone, 4-methyl-1-vinylpyrrolidone, 5-methyl-1-vinylpyrrolidone, 3-ethyl-1-vinyl pyrrolidone, 3-butyl-1-vinylpyrrolidone, 3,3-dimethyl-1-vinylpyrrolidone, 4,5-dimethyl-1-vinylpyrrolidone, 3,3,5-trimethyl-1-vinyl pyrrolidone, 4-ethyl-1-vinylpyrrolidone, 5-methyl-5-ethyl-1-vinylpyrrolidone, 3,4,5-trimethyl-3-ethyl-1-vinylpyrrolidone, and other lower alkyl substituted N-vinylpyrrolidones, N-vinyl-benzyldimethylamine, N-dimethylaminopropyl acrylamide and methacrylamide, N-methyacryloxyethylpyrrolidone, N-methacryloxyethylmorpholinone, N-methacryloxyethylmorpholine, N-maleimide of dimethylaminopropylamine, and the N-methacrylamide of aminoethethylineurea, or compounds having active silane functionalities, such as SiX, Si—(OR), SiH, SiOH, and $SiNH_2$, in which X is a halogen such as chlorine, bromine or iodine and R is an organic, aliphatic, aromatic, heterocyclic or cyclic group.

The preferred functional silane monomer is one containing an unsaturated aliphatic group attached to the silicon atom, such as vinyl trichlorosilane, vinyl trimethoxysilane, vinyl triethoxysilane, vinyl triacetoxysilane, vinyl tris(methoxyethoxy) silane, gamma aminopropyltriethoxy silane, mercapto propyltrimethoxy silane, methyldichloro silane, etc.

For a description of ethylene-monoolefin copolymers or terpolymers suitable for use as viscosity index improvers, and their method of manufacture, reference is made to U.S. Pat. No. 4,146,489 and the copending application of Joffrion, Ser. No. 76,386, filed Sept. 17, 1979, and entitled "Method of Grafting EPM and EPDM Polymers".

In accordance with the practice of this invention, an EPM or EPDM polymer of sufficiently high molecular weight to be handled in bale or conventional form is processed at the station of use to incorporate the polymer by solution in the lubricating or other oil. For this purpose, the rubber 10 is reduced by chopping, as in a Rietz chopper 12 to a particle size or form for feeding to an extruder 14.

The extruder 14, which is driven by an electrical motor 16 or other driving means, is of a length and maintained at a temperature to provide for the input of sufficient energy or work thermally and/or mechanically to bring about degradation of the polymer to a lower average molecular weight to exhibit the desired shear stable viscosity index improved property, during advancement of the polymer by the screw through the barrel of the extruder to the outlet orifice 18.

Mounted onto the exit end of the extruder is a chamber 20 through which hot oil is circulated from an inlet 22 at the bottom to an outlet 24 at the top. A knife 26 is mounted for rotation at relatively high speed across the outlet of the orifice 18 in position to engage the degraded polymer as it issues from the orifice, thereby to reduce the polymer to small pallets or sheared wafers 28 which are swept out into the oil stream for immediate entrainment in the oil circulating through the chamber 20, thereby to provide the effect of an under-oil pelletizer.

While most, if not all, of the pelletized degraded polymer will be taken into solution substantially immediately in the hot oil, any undissolved polymer will be carried with the oil, as a slurry, from the chamber 20 through the outlet 24 and through the conduit 32 to a tank 34 fitted with a stirrer 36, wherein solution is completed.

It will be understood from this brief description that the polymer is not handled once it is fed to the chopper, but instead flows as a continuous process in a closed system until it is taken into solution in the oil. The amount of oil circulated through the chamber 20 to take up the degraded EPM or EPDM polymer may be in the proportion desired for ultimate use of the lubricant, in which the polymer is present in a concentration within the range of 3–15% by weight, or oil may be added to the solution after it is formed to dilute the concentration of the polymer to the desired level.

The extruder chamber is maintained at a temperature within the range of 200°–400° F. and the oil is circulated through the chamber 20 at a temperature above that which might cause the degraded polymer to freeze at the exit orifice and thus interfere with the smooth and continuous operation of the system. In practice, it is desirable to circulate the oil through the chamber at a temperature generally corresponding to the temperature of the polymer at the orifice up to a temperature below that at which the oil begins thermally to degrade, and preferably at a temperature within the range of the extrusion temperature to 50° F. above the temperature at the die face of the extruder.

It has been found that the work performed on the polymer, during passage through the extruder, preferentially reduces the longest polymer chain thereby to reduce the peak, with the result that the molecular weight distribution of polymer issuing from the extruder into the hot oil is more uniform and relatively free of high molecular weight polymer that is more difficult to take into solution.

Reduction of the degraded polymer to lower molecular weight plus the combination of reductions of the polymer into small particles or wafers for admixture with the circulating hot coil, coupled with the agitation induced by the pelletizer, operates to enhance solution of the polymer whereby it is almost immediately taken into solution before the material reaches the chamber 20.

By way of example, an EPM polymer formed of 55–65 mole percent ethylene and 45–35 mole percent propylene and 1.2% by weight N-vinylpyrrolidone, having a viscosity of 1.5–2.5 RSV is chopped and processed through an extruder at a temperature of 400° F. The polymer exiting from the die face of the extruder into engagement by the revolving knife is reduced to a viscosity of 0.8 to 1.5 RSV.

A super-refined paraffinic oil, such as Solvent Neutral 100 oil, is circulated through the chamber 20 at a temperature of 400°–425° F., at a rate to take up polymer to provide an 8–15% by weight solution.

The use of such hot oil will be effective not only to increase solvent efficiency but also to reduce the temperature and pressure differential across the die face of the extruder, thereby to minimize investment in equipment while conserving energy.

As used herein, the term "EPM and EPDM polymers" is meant to include such EPM and EPDM polymers and modifications thereof in the form of grafts and copolymers with monomers such as N,N-vinyl dialkyl, amino alkyl, acrylates or methacrylates and/or with N,N-vinylpyridine or N-vinyl pyrrolidone, including cross links thereof with agents such as dichloroxylene, as described in the aforementioned U.S. Pat. No. 4,146,489, my copending application Ser. No. 336,849, filed Apr. 9, 1982 as a division of Ser. No. 76,386, filed Sept. 17, 1979 (now U.S. Pat. No. 4,340,689) and as described in the copending applications of Tom Tsai, Ser. No. 303,870, filed Sept. 21, 1981 as a continuation-in-part of application Ser. No. 208,570, filed Nov. 20, 1980 (now abandoned); Ser. No. 268,173, filed May 29, 1981; Ser. No. 268,173, filed May 29, 1981; Ser. No. 256,005, filed Apr. 22, 1981, and U.S. Pat. No. 4,316,825, issued Feb. 23, 1982.

It will be understood that changes may be made in the details of construction, arrangement and operation, without departing from the spirit of the invention, especially as defined in the following claims.

I claim:

1. The method of taking a solid, high molecular weight EPM or EPDM polymer into solution in oil comprising the steps of working the polymer to effect degradation of the polymer during passage through an extruder at elevated temperature, reducing the particles to small dimension as the degraded polymer issues from the die face of the extruder, and circulating hot oil across the die face of the extruder, whereby the polymer particles become admixed with the oil for solution therein.

2. The method as claimed in claim 1 which includes the step of maintaining the admixture of degraded polymer in hot oil until solution of the polymer in the oil is completed.

3. The method as claimed in claim 1 which includes the step of reducing the polymer to smaller dimension before feeding into the extruder.

4. The method as claimed in claim 1 which includes the step of heating the extruder to elevated temperature sufficient to reduce the polymer to a plastic stage but less than the decomposition temperature of the polymer.

5. The method as claimed in claim 4 in which the polymer is heated to a temperature of about 400° F. during passage through the extruder.

6. The method as claimed in claim 1 in which the polymer is reduced to particle size upon issuance from the extruder by the passage of a cutting knife at high speed across the die face of the extruder.

7. The method as claimed in claim 1 in which the hot oil is at a temperature within the range of the temperature of the polymer issuing the extruder up to the temperature of decomposition of the oil.

8. The method as claimed in claim 1 which includes the step of agitating the oil for suspension of the polymer particles therein to accelerate solution.

* * * * *